US007730809B2

(12) United States Patent
Creato et al.

(10) Patent No.: US 7,730,809 B2
(45) Date of Patent: Jun. 8, 2010

(54) TOOLS FOR REMOVING SHINGLES

(76) Inventors: Timothy Frost Creato, 50 Hamblen Way, Edgartown, MA (US) 02539; Michael J. Creato, 40 Hamblen Way, Edgartown, MA (US) 02539

( * ) Notice: Subject to any disclaimer, the term of this patent is extended or adjusted under 35 U.S.C. 154(b) by 0 days.

(21) Appl. No.: 11/717,609

(22) Filed: Mar. 13, 2007

(65) Prior Publication Data

US 2008/0223178 A1 Sep. 18, 2008

(51) Int. Cl.
*E04D 15/00* (2006.01)

(52) U.S. Cl. ..... 81/45

(58) Field of Classification Search ..... 81/45; 30/170, 171

See application file for complete search history.

(56) References Cited

U.S. PATENT DOCUMENTS 4,219,238 A 8/1980 Sanchez
4,756,578 A * 7/1988 Mims et al. ..... 30/170
5,218,766 A * 6/1993 Himebaugh ..... 81/45
6,393,948 B1 * 5/2002 Hutchins ..... 81/45
2006/0026909 A1 2/2006 Cross
2006/0086209 A1 4/2006 Kingham
2006/0156866 A1 7/2006 Ingell
2006/0191378 A1 8/2006 Linscott

* cited by examiner

*Primary Examiner*—Hadi Shakeri
(74) *Attorney, Agent, or Firm*—Stahl Law Firm

(57) ABSTRACT

The present invention relates to tools for removing shingles, nails and other materials from a roof or other surface. A tool of the invention, in certain embodiments, comprises blades that move in preferably a reciprocating manner to pry up shingles, nails and other materials. A tool of the invention, in certain embodiments, can be powered through a remote power source to move the blades. In certain other embodiments, a tool of the invention comprises a drive-wheel which is rotated through force form a remote power source.

9 Claims, 7 Drawing Sheets

TOOLS FOR REMOVING SHINGLES

1.0 FIELD OF THE INVENTION

Figure 1:
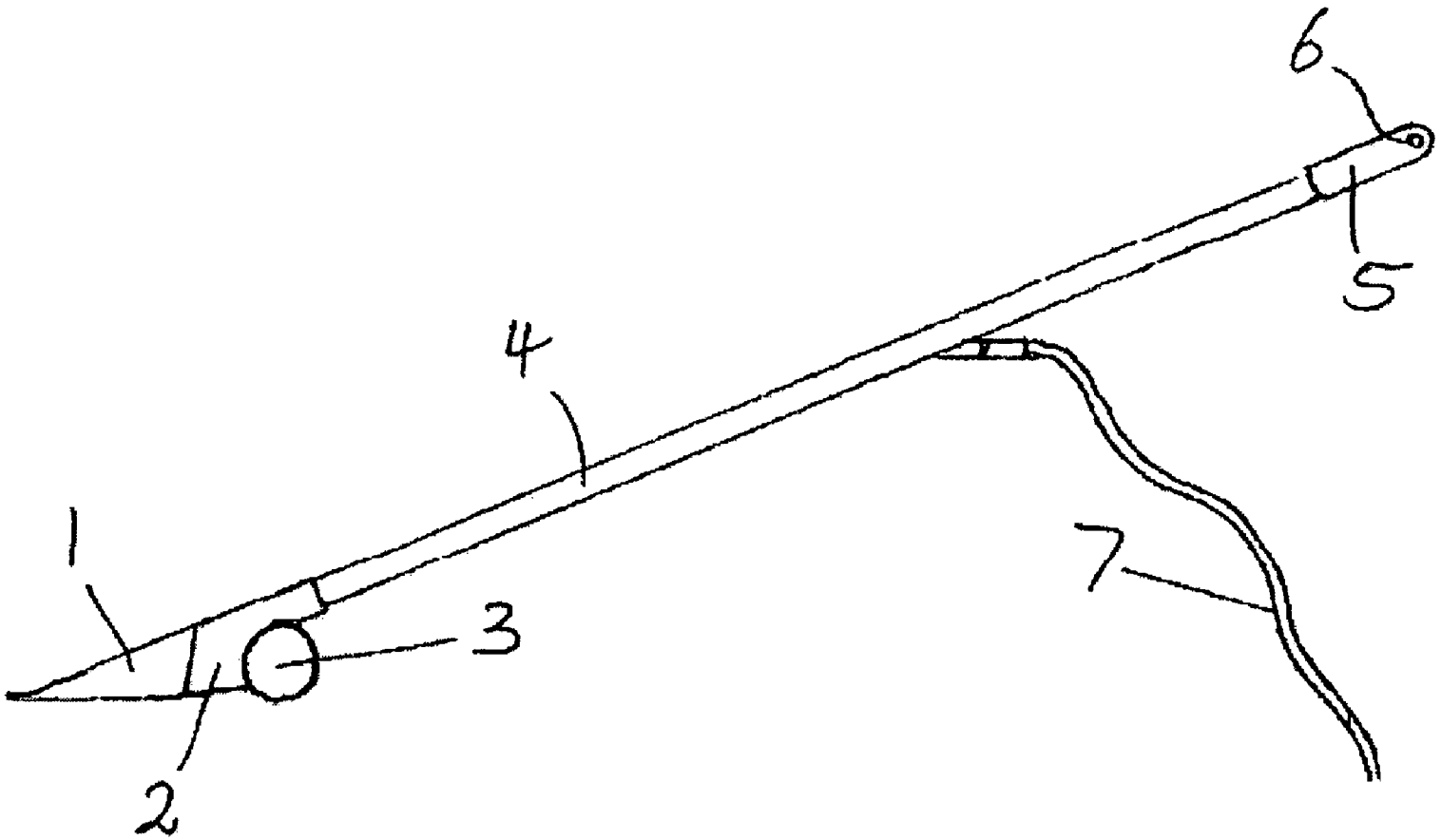

The invention relates to tools for removing shingles, nails and other materials from a roof or other surface. Tools of the invention facilitate the removal of shingles, nails and other materials without substantial damage to the roof and preferably leaving the roof substantially suitable to cover it with a new set of shingles.

2.0 BACKGROUND

Shingles are used to cover roofs and walls of houses and other buildings. Shingles typically offer protection from rain, snow and other adverse weather conditions. Due to wear and tear, shingles need replacement from time to time. In order to replace existing shingles with new shingles, the existing shingles are usually first removed and the new shingles are installed thereafter. Removing existing shingles can be a labor and time consuming task, especially as shingles are typically firmly attached, for example, through nails, staples or other means that prevent easy removal of the shingles. The task of removing shingles is often made further challenging because the shingles are in hard to reach places, at considerable elevation, and on surfaces that are slanted at various angels, including vertical surfaces. Thus, removing shingles often requires considerable force and must be accomplished under difficult working conditions.

A tool that is powered and easy to operate would greatly facilitate the task of removing shingles. Such a tool would be particularly useful if it was light in weight and easy to maneuver as the tool may be used under difficult working conditions and may be operated with one hand. Also, a useful shingle removal tool is preferably capable of generating the force necessary to remove shingles and other materials like nails, staples, or other fastening devices. The force needed for removing shingles and other materials is preferably generated without exposing the tool operator to significant forces and without requiring that the operator apply significant force to the tool, thus making the removal process less demanding for the operator and also avoiding unnecessary risks to the operator while working on a slanted surface. A desirable shingle removal tool should also be able to remove shingles and other materials without exerting significant forces on the surface from which the shingles are removed. Shingled surfaces are typically made of materials like wood that cannot withstand high pressure or stress while remaining undamaged.

A shingle removal tool that better satisfies these criteria would be highly desirable. The present invention provides such tools.

3.0 SUMMARY OF THE INVENTION

The present invention relates to tools for removing shingles, nails, staples and other materials (collectively referred to as roofing materials) from a roof or other surface. A tool of the current invention, in certain embodiments, removes roofing materials by prying them loose or separating them from the roof or other surface through blades.

In certain embodiments, blades of a tool of the invention pry loose or separate roofing materials by being forced under those materials (or under parts of those materials, for example, nail heads) through power from a remote power source, through a powered drive-wheel, or through both. In certain embodiments, a remote power source powers a forward movement of blades of the tool (in other words forward relative to the tool overall), preferably so that the blades are forced further under roofing materials when the tool is used and thereby preferably generating an upward force (in other words, upward relative to the roof or other surface) for removing roofing materials. In certain other embodiments, blades of a tool of the invention are powered to engage in a motion that is reciprocating or intermittent. In certain other embodiments, blades of a tool of the invention move forward and backward (in other words towards the roofing materials and back during use of the tool), and in certain other embodiments the movement of the blades has a directional component other than forward and backward, for example, resulting in an elliptical, rotary, or oscillating motion.

A tool of the current invention, in certain embodiments, comprises a spade assembly, in certain other embodiments, a spade assembly and a remote power source. In certain other embodiments, a spade assembly of a tool of the invention comprises blades and a powering mechanism. In certain other embodiments, a spade assembly comprises blades, a powering mechanism and a drive-wheel. In certain preferred embodiments, a spade assembly does not comprise a power source. In certain other embodiments, a spade assembly of a tool of the current invention comprises a ramp between blades. In certain preferred embodiments, a tool of the invention comprises a cutting edge at the bottom of the ramp.

A tool of the current invention also comprises, in certain embodiments, means to facilitate the delivery of power from a remote power source to the powering mechanism. In certain embodiments, the powering mechanism powers movement of the blades and a drive-wheel of the tool of the invention.

In certain other embodiments, the invention relates to methods for removing roofing materials from a roof or other surface by using a tool of the current invention.

4.0 BRIEF DESCRIPTION OF THE DRAWINGS

FIG. 1 shows an example of a tool according to certain embodiments of the invention. The numerals refer to the following: blade (1); powering mechanism (2) (for example, a mechanism that allows compressed air to move the blade(s) in a reciprocating manner and to rotate the drive-wheel); drive-wheel (3); bar (4); handle (5); power switch (6); power delivery means (7) (for example, air hose to compressor). The exemplified tool has a handle (5) with a power switch (6). A bar (4) connects the handle (5) with a spade assembly (1-3) for prying roofing materials from the roof or other surface. The exemplified spade assembly includes a blade(s) (1) and a drive-wheel(s) (3). During operation of the tool, the leading edge of the blades is inserted under the roofing materials. The blades (1) are powered to move forward and back to pry loose any roofing materials. The drive-wheel (3) moves the tool forward so the prying force of the blades can be applied effectively. The tool may be powered through compressed air that is fed into the tool through a hose from a compressor (not shown) and leading into the connecting bar (4).

Figure 2:
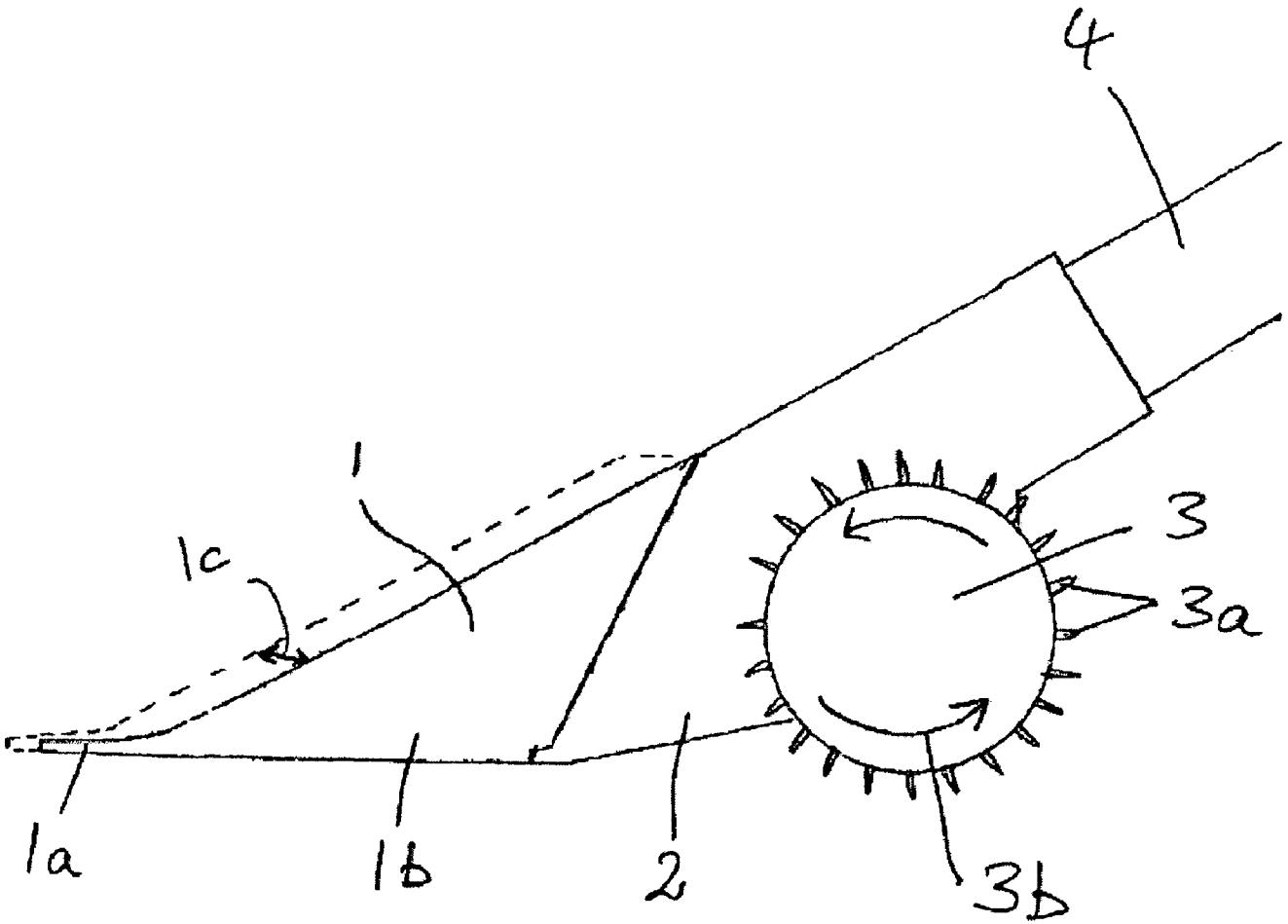

FIG. 2 exemplifies an enlarged view of a spade assembly with blades and a drive wheel of a tool according to certain embodiments of the invention. The numerals refer to the following: blade (1); leading edge (1*a*) of blade; body (1*b*) of the blade; arrow (1*c*) illustrating a reciprocating movement of the blade(s); powering mechanism (2); drive-wheel (3); tooth (3*a*) on drive-wheel; arrow (3*b*) illustrating the direction in which the wheel is driven to rotate; bar (4).

Figure 3:
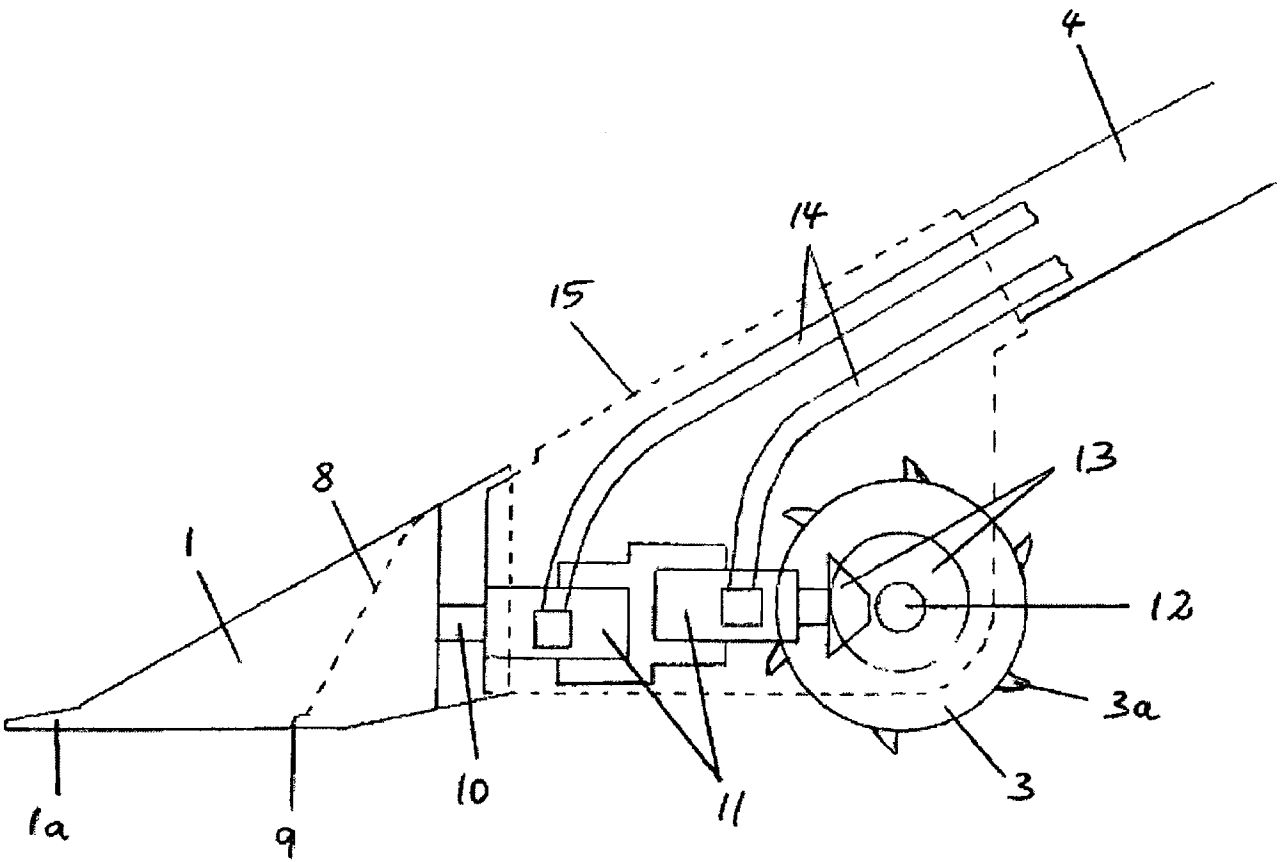

FIG. 3 exemplifies a spade assembly of a tool according to certain embodiments. FIG. 3 includes a transparent representation of a housing (15) for the powering mechanism. FIG. 3 further illustrates certain components of the powering mechanism. In this embodiment, pneumatic hoses (14) are shown in the bar (4) and the housing (15). The hoses (14) direct air pressure from a remote power source to power a pneumatic cylinder (11). Power is delivered from a pneumatic cylinder (11) through two bevel gears (13) and a drive wheel axle (12) to a drive-wheel (3) with teeth (3*a*). A pneumatic cylinder (11) also powers a pneumatic shaft (10) which results in a reciprocating movement of blades (1). Also illustrated is a ramp (8) between blades (1) which may assist in moving materials between the blades up and/or out from between the blades. A cutting blade (9) is illustrated at the bottom of the ramp (8). The cutting blade (9) moves along the surface from which roofing materials are removed and assists in clearing off materials from the surface.

Figure 4:
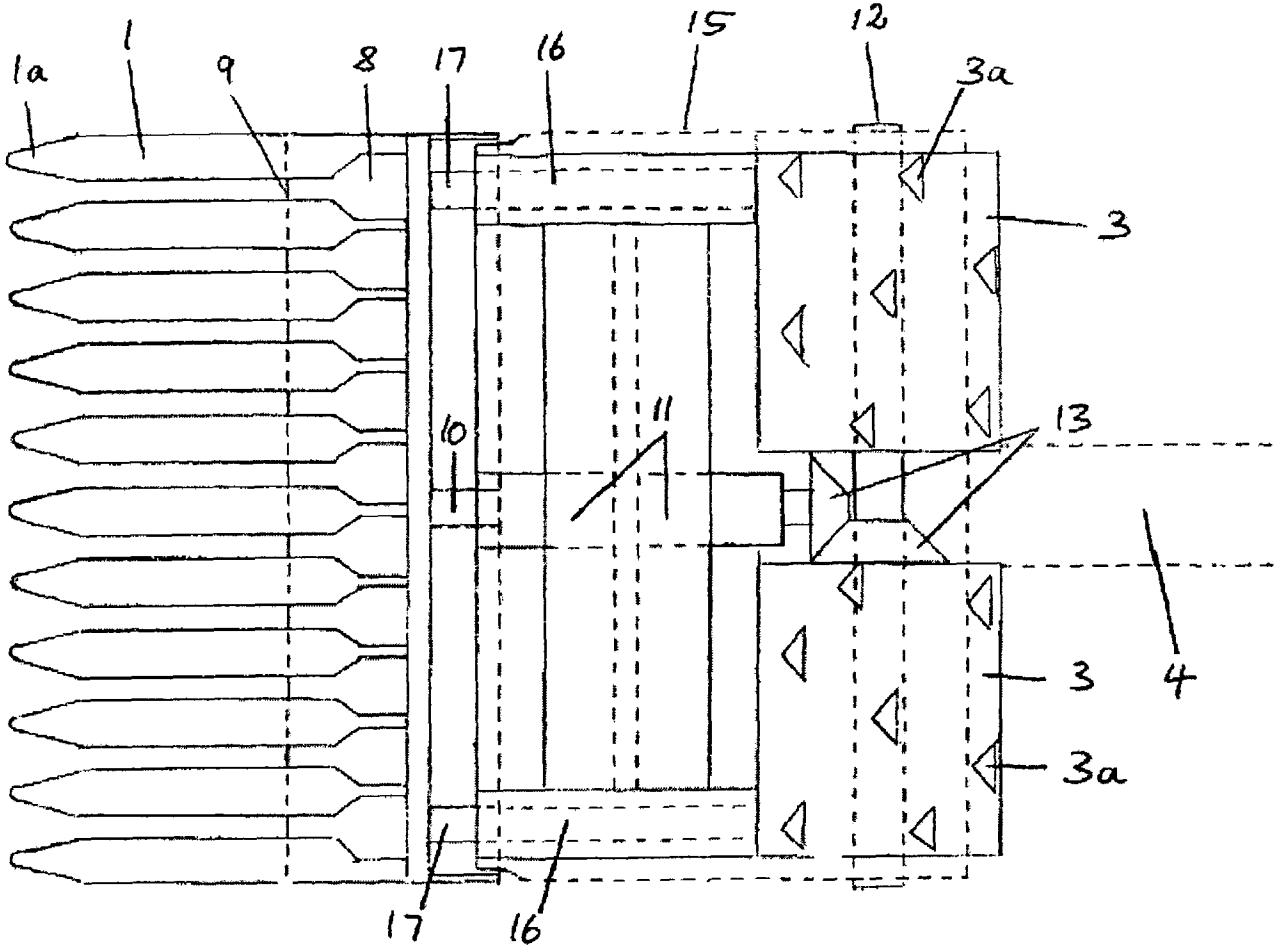

FIG. 4 shows a top view of the spade assembly exemplified in FIG. 3. FIG. 4 shows two drive-wheels (3). FIG. 4 also illustrates guides (16) and shafts (17) to guide a reciprocating or intermittent movement of the blades (1).

Figure 5:
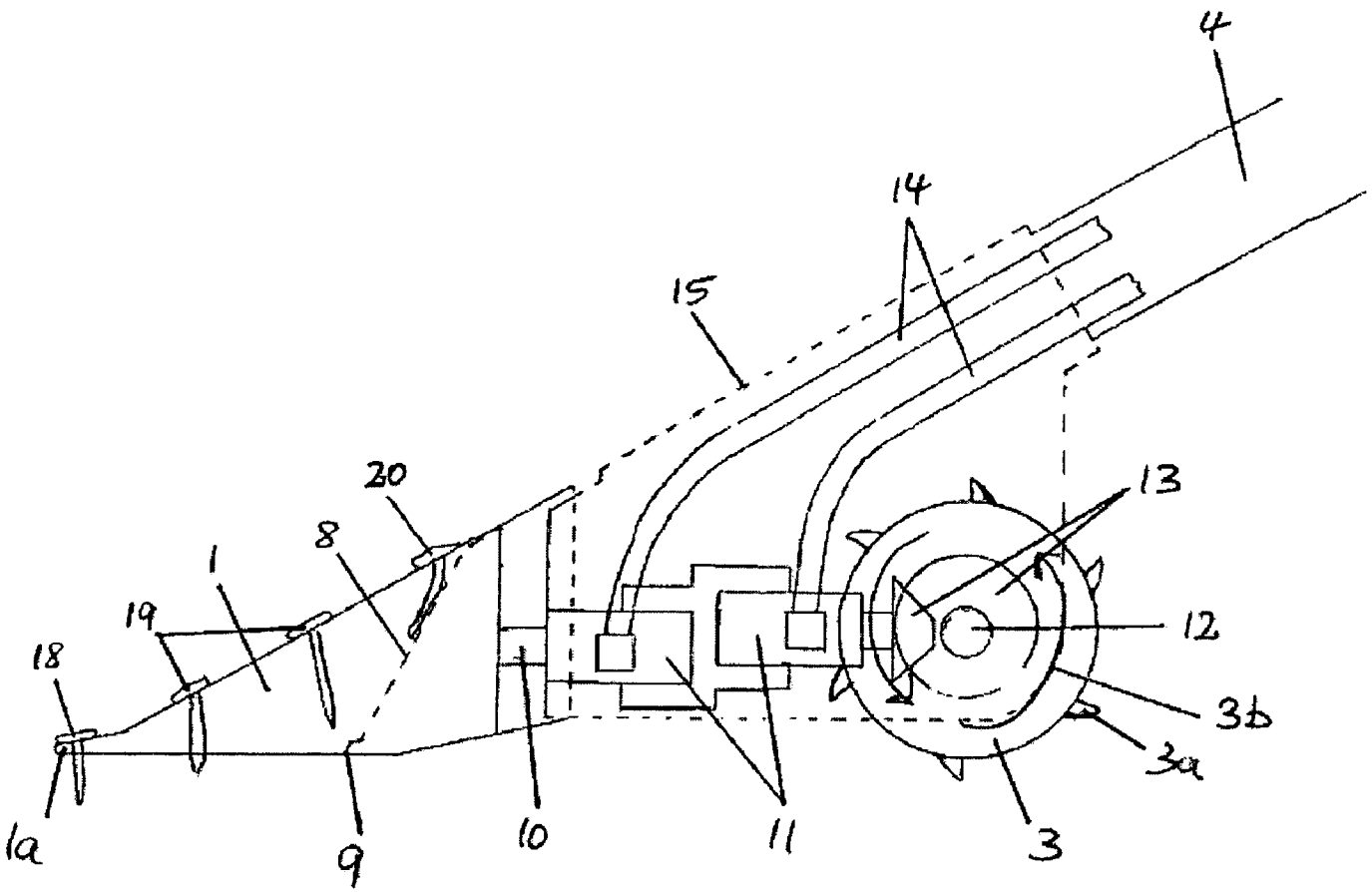

FIG. 5 illustrates how a tool exemplified in FIG. 3 removes nails (18-20) from a surface. First, the leading edge of blades (1*a*) insert underneath the nail heads (18). The reciprocating movement of the blades (1) of the tool, and the forward movement of the tool through the rotation (3*b*) of the drive-wheel, moves the nails further up (19) the blades (1) until the nails (20) reach the ramp (8).

Figure 6:
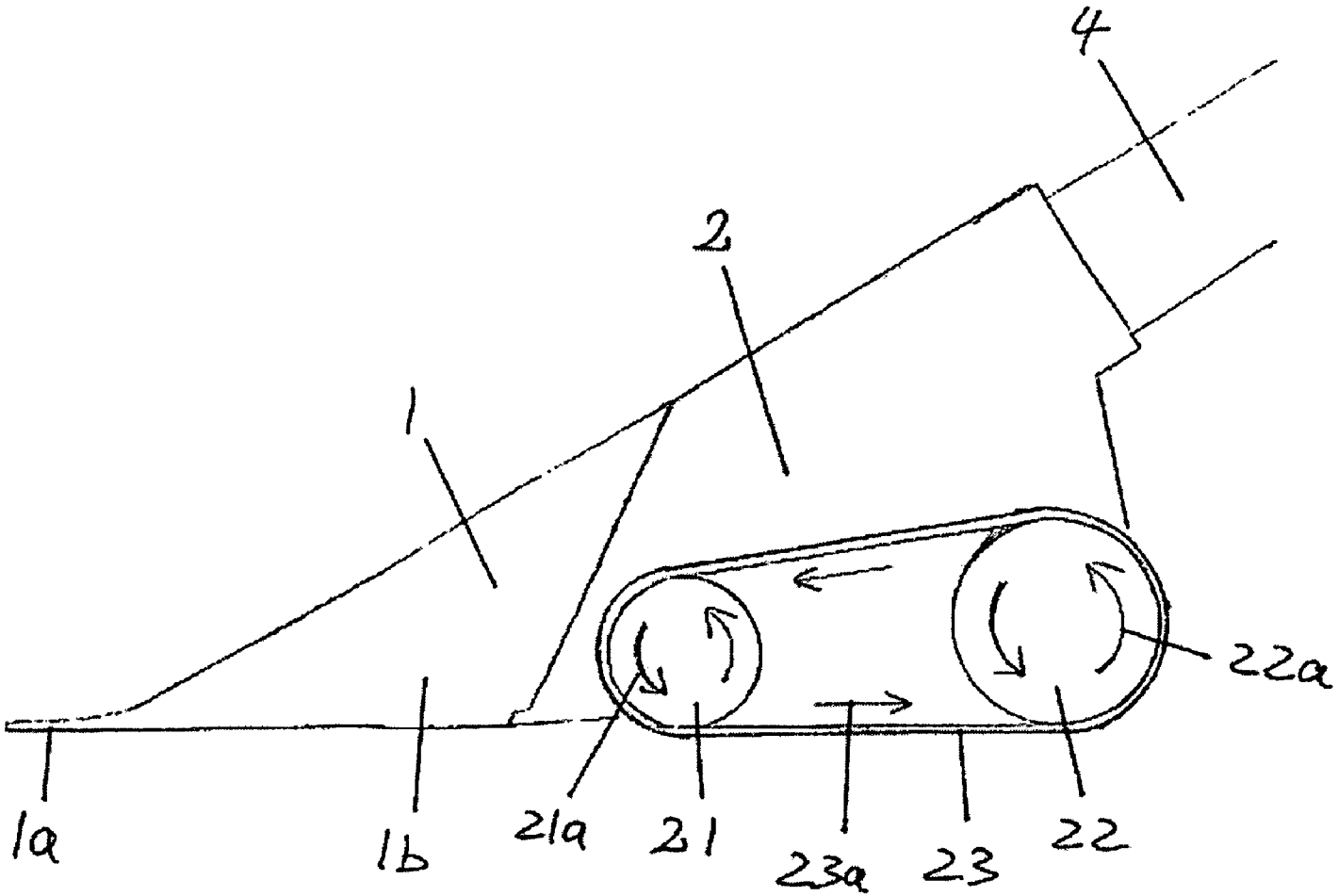

FIG. 6 exemplifies a spade assembly with blades (1), a front drive-wheel (21), a rear drive-wheel (22) and a drive belt (23) according to certain embodiments of the invention. Arrows (21*a*, 22*a*, 23*a*) illustrate the direction in which the drive-wheels (21 and 22) and the drive belt (23) rotate. Also illustrated are the leading edge (1*a*) of a blade, the body (1*b*) of a blade, the powering mechanism (2), and the bar (4).

Figure 7:
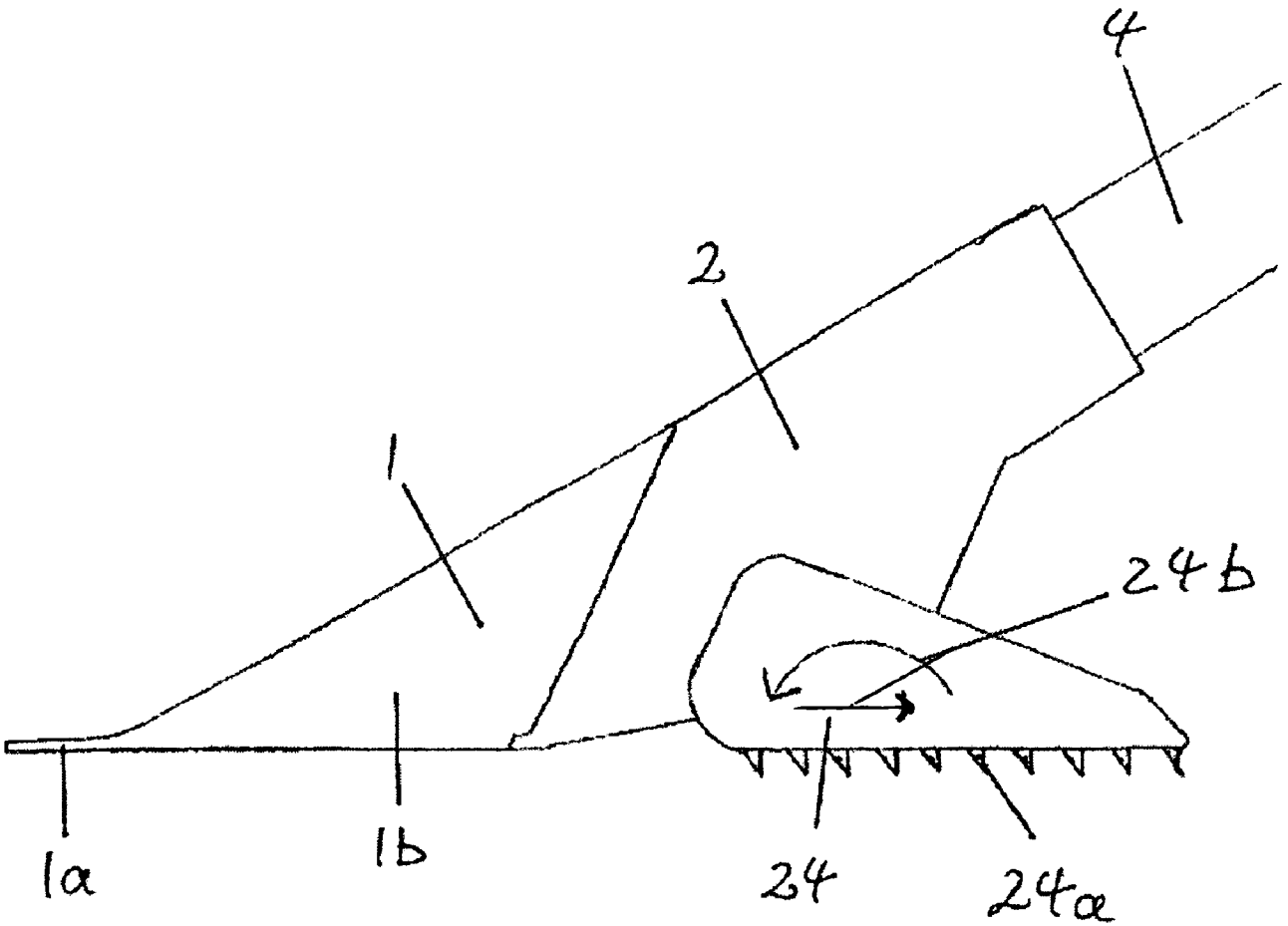

FIG. 7 exemplifies a spade assembly with blades (1) and a drive-foot (24) with teeth (24*a*) according to certain embodiments of the invention. Arrows (24*b*) illustrate a forward and backward movement of the drive-foot (24). Preferably, half the number of drive-feet moves forward at one time while the other half remains on the roofing surface. Also illustrated are the leading edge (1*a*) of a blade, the body (1*b*) of a blade, the powering mechanism (2), and the bar (4).

5.0 DETAILED DESCRIPTION OF THE INVENTION

The present invention relates to tools for removing roofing materials such as shingles, nails and other materials. A tool of the current invention, in certain embodiments, is light in weight so that it can be operated by a person, preferably under various conditions, for example, on a slanted roof top. In certain embodiments, a tool of the invention has blades to pry loose roofing materials. In certain other embodiments, a tool of the invention is powered through a remote power source. In certain other embodiments, a tool of the invention is powered to move along the surface on which roofing materials are removed, for example, through a drive wheel.

5.1 Tools of the Current Invention.

A tool of the current invention, in certain embodiments, has a spade assembly. A spade assembly, in certain embodiments, includes blades. In certain other embodiments, a spade assembly includes a drive wheel. In certain preferred embodiments, the blades of a spade assembly move during operation of the tool, preferably in a way that allows the blades to engage roofing materials. In certain preferred embodiments, the blades of a spade assembly move in a reciprocating manner and in certain other preferred embodiments, the blades engage underneath roofing materials but above the roof, wood sheathing of the roof, or other surface during operation of the tool. In certain preferred embodiments, roofing materials are pried loose through the engaging blades.

In certain embodiments, a tool of the invention has a handle. In certain other embodiments, a person operating said tool preferably holds on to the handle during operation of the tool. A tool of the invention, in certain embodiments, includes a power switch. The power switch may be located in different positions, preferably on the handle or close to the handle, for example, within 2 centimeters, within 5 centimeters, within 10 centimeters, within 20 centimeters or within 50 centimeters of the handle. In certain other embodiments, a tool of the invention includes a power switch that turns the tool off as soon as the operator ceases to engage the switch.

In certain other embodiments, a tool of the invention includes a bar. In certain preferred embodiments, a bar connects a spade assembly with a handle in the tool. The length of a bar in a tool of the invention, in certain embodiments, is so that a person of average height may operate the tool while standing, preferably so that the spade assembly reaches the roof or other surface of operation at an angle that allows blades of the spade assembly to engage roofing materials. In certain other embodiments, a bar in a tool of the invention is short enough so that the tool may be operated in a hunched or kneeling position. In certain embodiments, a tool of the invention does not include a bar and the handle is connected directly to the spade assembly.

In certain preferred embodiments, a bar in a tool of the invention is at an angle relative to the roof or surface of operation during operation of the tool, for example, at an angle of 5 to 70 degrees, 10 to 70 degrees, or 20 to 60 degrees, or 30 to 50 degrees, or 35 to 45 degrees. In certain other embodiments, a bar in a tool of the invention is 5 to 150 centimeters long, or 5 to 30 centimeters, or 10 to 20 centimeters, or 50 to 150 centimeters, or 70 to 130 centimeters, or 100 to 120 centimeters.

A tool of the invention, in certain other embodiments, is powered, preferably through a remote power source. As used herein, a power source is "remote" if it is not connected to the spade assembly in a static manner, so that the spade assembly can be moved during operation of the tool without that the power source is moved. In certain preferred embodiments, power is fed from the power source into a tool of the invention, for example, through a hose. In certain other embodiments, power is fed into a tool of the invention is one or more locations, for example in 2, 3, 4, 5 or more locations. Locations for feeding power into a tool of the invention, in certain embodiments, are on the spade assembly, on the bar, on the handle, or on any one, two or three thereof.

A tool of the current invention, according to certain embodiments, is illustrated in FIGS. 1 to 5. FIG. 1 shows an example of a tool according to certain embodiments of the invention. The exemplified tool includes a blade or blades (1) (the side-view shows only one blade); a powering mechanism (2) (shown is a housing (15) in which the mechanism is located) that allows the tool to power the blades (for example, through reciprocating movements); a drive-wheel (3) for moving the tool on the roof or other surface towards the roofing materials (the side-view shows only one wheel, although the tool may comprise more than one wheel); a bar (4) to connect the prying mechanism with a handle; also, power may be fed into the bar (for example, a hose from a compressor may be hooked up to the bar so that the compressed air may operate the mechanism for powering the blade(s) and the wheel(s)); a handle (5) for the operator to hold the tool during operation; a power-switch (6) to turn the tool on (the power switch may be located elsewhere, for example on the bar and the power switch may be designed to turn off the tool when not engaged by the operator); a power delivery means (7) (as shown in this example, an air hose from a compressor) for supplying power into the tool to operate the blades (1) (for example, reciprocating or forward/backward motion of the blades) and the drive-wheel (3).

FIG. 2 shows an example of an enlarged view of a spade assembly with blades and a drive wheel of a tool according to certain embodiments of the invention. The exemplified blade (1) has a leading edge (1*a*) and a body (1*b*). During operation of the tool, the leading edge (1*a*) is inserted under roofing materials that are to be removed from the roof or other surface. The arrow (1*c*) illustrates a reciprocating movement of the blade(s) (1) to push the blade(s) under the roofing materials to pry them loose. A powering mechanism (2) moves the blade(s) (1) and a drive-wheel(s) (3). The drive-wheel(s) (3) moves the tool forward and thus assists in moving the blade(s) (1) towards and thus under the roofing materials. The drive-wheel(s) (3) is shown with teeth (3*a*) to improve the traction of the drive-wheel (3) on the roof or other surface and thus move the tool forward more effectively. The arrow (3*b*) illustrates the direction in which the wheel is driven to rotate by the powering mechanism (2).

FIGS. 3 and 4 exemplify further detail of the powering mechanism shown from the side in FIG. 3 and from the top in FIG. 4. As show in this embodiment, two pneumatic hoses (14) lead through the bar (4) into the powering mechanism (2) in the spade assembly. The hoses (14) deliver power (for example, pressurized air) from a remote power source that is fed into the tool through a power delivery means (7). The hoses (14) deliver power to pneumatic cylinders (11). One pneumatic cylinder (11) drives a bevel gear (12) that turns a second bevel gear (12) on the drive wheel axis (13) of the drive-wheel (3). One pneumatic cylinder (11) drives a reciprocating movement of a pneumatic shaft (10) that is connected to blades (1). FIG. 4 also illustrate a guide (16) in which a shaft (17) moves that is connected to blades (1). The guides (16) facilitates for example that the blades (1) can engage in reciprocating or intermittent movement without rotating around the pneumatic shaft (10). FIGS. 3 and 4 also exemplify a ramp (8) between blades (1) to facilitate that nails and other materials engaged between blades (1) are moved upwards and preferably out of the space between blades (1). Also exemplified is a cutting blade (9) at the bottom end of the ramp (8) to facilitate clearing undesired materials from the roof or surface from which roofing materials are removed.

FIG. 5 exemplifies how a tool in certain embodiments of the invention removes nails from a roof or other surface. The leading edge of a blade (1*a*) engages a nail underneath the nail head (18). The nail moves further in between blades (1) and is thereby pulled out of the surface material (19). The nail eventually reaches the ramp (8) of the tool.

FIG. 6 exemplifies a drive-wheel variation according to certain embodiments of the invention. A front drive-wheel (21) and a rear drive-wheel (22) are illustrated with a drive belt (23) around the drive-wheels (21 and 22). The drive-wheels turn and thereby move the drive belt in a forward direction, in other words towards the roofing materials that is to be removed, according to this embodiment. The drive belt is preferably made designed and of a material so it is sufficiently flexible to move around the drive-wheels and preferably has traction on a roofing surface, for example, a rubber, a plastic, a chain, a metal, an alloy, or a mixture thereof. A drive belt may have an inner layer providing stability and an outer layer providing traction on a roofing surface. A drive belt according to certain embodiments may have teeth, preferably small teeth, on the outside to improve traction. A drive belt may have to be replaced from time to time.

FIG. 7 exemplifies a tool according to certain embodiments of the invention with a drive-foot (24) with teeth (24*a*). A tool according to this embodiment of the invention preferably has multiple drive-feet and preferably moves forward by moving less than all drive-feet forward at one time (preferably half), while the remaining drive-feet are moved forward thereafter. A drive-foot (24) according to this embodiment may be moved forward by a powering mechanism that facilitates forward movement of select drive-feet, for example by attaching each drive-foot to a separate rotating wheel that is powered by the powering mechanism. A drive-foot (24) and teeth (24*a*) may be of many different shapes, for example a square, a rectangle, a diamond, or any other shape suitable for a drive-foot. A drive-foot (24) and teeth (24*a*) may be of a material with sufficient stability and traction, for example a material useful for a drive-wheel (3) and teeth (3*a*).

5.2 Spade Assembly.

A tool of the present invention, in certain embodiments, includes a spade assembly. A spade assembly, in certain embodiments, may comprise blades, a drive-wheel, a powering mechanism to power the blades and/or the drive-wheel, a housing, or any combination of less than all of these components. In certain preferred embodiments, a spade assembly does not comprise a power source.

5.2.1 Blades.

A tool of the present invention includes blades. In certain embodiments, blades of a tool of the invention pry loose or separate roofing materials by being forced under those materials (or under parts of those materials, for example, nail heads) through power from a remote power source, through a powered drive-wheel, or through both. In certain embodiments, a remote power source powers a forward movement of blades of the tool (in other words forward relative to the tool overall), preferably so that the blades are forced further under roofing materials when the tool is used and thereby preferably generating an upward force (in other words, upward relative to the roof or other surface) for removing roofing materials. In certain other embodiments, blades of a tool of the invention are powered to engage in a motion that is reciprocating or intermittent. In certain other embodiments, blades of a tool of the invention move forward and backward (in other words towards the roofing materials and back during use of the tool), and in certain other embodiments the movement of the blades has a directional component other than forward and backward, for example resulting in an elliptical, rotary, or oscillating motion.

Blades in a tool of the invention are arranged so that a blade-edge is closest to the shingled surface when the tool is used (lower edge), in other words, the blade-surfaces are arranged at an angle of 90 degrees relative to the shingled surface, or 85 to 95 degrees, or 80 to 100 degrees, or 75 to 105 degrees relative to the shingled surface when the tool is used. Blades of a tool of the invention, in certain preferred embodiments, are arranged in parallel to each other, or at an angle of 1 to 5 degrees relative to each other, or 4 to 10 degrees, or 8 to 15 degrees. In certain other embodiments, blades are spaced apart from each other so that nails and staples can fit between the blades while the top of the nails and staples does not fit between the blades. In certain embodiments, the blades are from 0.5 to 20 millimeters (mm) apart from each other, or from 1 to 15 mm, or from 2 to 10 mm, or 3 to 8 mm, or 4 to 6 mm, at or around the middle of the blades. In certain embodiments, the distance between blades is greater at the front than in the middle.

A tool of the invention, in certain embodiments, includes from 2 to 2000 blades, or from 10 to 1000, or from 20 to 500, or from 30 to 300, or from 40 to 200, or from 50 to 100, or from 100 to 200, or from 200 to 300, or from 300 to 400 blades. The number of blades in a tool of the invention is preferably so that the tool may be moved along when used to remove roofing materials from a roof or other surface, preferably without requiring too much force and preferably without causing damage to the roof or other surface under the roofing materials. For example, when a tool of the invention has a drive wheel, the number of blades should not be so high to require that the drive wheel engages the roof with so much force as to damage the roof or other surface under the roofing materials that are to be removed. A blade used in a tool of the invention, in certain embodiments, is made of any material that is strong enough to pry loose roofing materials. Examples of such materials include a metal, an alloy, a light metal, aluminum, iron, titanium, a plastic, a composite.

A blade used in a tool of the invention, in certain embodiments, has a leading edge that engages the surface with roofing materials thereon at a shallow angle when the tool is used. In certain other embodiments, a blade in a tool of the invention has a body that engages the surface with roofing materials at a steeper angle than the leading edge when the tool is used. The angle at which a leading edge or body of a blade engages a surface is the angle between the top of the leading edge or body of the blade and the surface. The leading edge, in certain embodiments, engages the surface at an angle of between 0 and 30 degrees, between 2 and 20 degrees, between 4 and 15 degrees, between 5 and 10 degrees, or between 6 and 8 degrees. The body of the blade, in certain embodiments, engages the surface at an angle of between 10 and 60 degrees, between 15 and 50 degrees, between 20 and 40 degrees, or between 25 and 30 degrees. In certain other embodiments, the length of the leading edge, when measured along the direction of movement of the tool, is from 1 to 100 mm, or from 2 to 50 mm, or from 4 to 30 mm, or from 6 to 20 mm, or from 8 to 12 mm. The length of the body of the blade, in certain embodiments, when measured along the direction of movement of the tool, is from 5 to 200 mm, or from 10 to 150 mm, or from 20 to 100 mm, or from 30 to 80 mm, or from 40 to 60 mm.

The body of a blade in a tool of the invention, in certain embodiments, is dimensioned so that a nail, a staple, or other fastening means is pried loose from, and preferably removed from, the roof or other surface. For example, if the body of the blade engages the surface at a smaller angle, then the blade had to be longer so that it has sufficient maximum height to pry loose, and preferably remove, nails, staples, and other fastening means from the roof or other surface. The maximum height of a blade in the tool of the invention, in certain embodiments, is from 10 to 200 mm, or from 15 to 150 mm, or from 20 to 100 mm, or from 25 to 80 mm, or from 30 to 60 mm, or from 40 to 50 mm.

The thickness or width of blades of a tool of the invention, in certain embodiments, is sufficient to render the blades strong enough to pry loose roofing materials. In certain embodiments, blades may be thicker when they are made of a material of lesser strength and blades may be thinner when they are made of a material of higher strength The thickness or width of blades, in certain embodiments, is from 0.2 to 20 mm, or from 1 to 15 mm, or from 2 to 10 mm, or from 3 to 6 mm, at or around the middle of the blades. In certain embodiments, the thickness or width of blades is less at the front than in the middle. In certain embodiments, all blades of a tool of the invention are of equal thickness, or approximately equal thickness. In certain other embodiments, the thickness of blades in a tool of the invention may vary, for example, blades on the periphery may be thicker or thinner than blades in the center.

5.2.2 Ramp.

A tool of the invention, in certain embodiments, comprises a ramp between blades of the tool. In certain embodiments, a ramp in a tool of the invention removes roofing materials between blades of the tool, for example, nails, staples, shingles or fragments thereof, tar paper, and any other materials that need to be removed. A ramp, for example, connects blades of the tool and, in certain embodiments, a ramp is a surface that engages the surface from which roofing materials are to be removed at an angle that is the same as or steeper than the angle at which the top surface of blades of the tool engage the surface, for example, 10 to 30 degrees steeper, or 20 to 40 degrees, or 30 to 50 degrees, or 20 to 30 degrees. The angle at which a ramp engages a surface is the angle between the ramp and the surface. The ramp, in certain embodiments, engages the surface at an angle of 30 to 80 degrees, or 40 to 70 degrees, or 50 to 60 degrees.

In certain other embodiments, a ramp of a tool of the invention has a cutting blade at its lower end. A cutting blade, in certain preferred embodiments, is located close to the surface from which roofing materials are removed when the tool is operated, for example, from 0 to 20 mm, or from 1 to 10 mm, or from 2 to 5 mm. In certain other embodiments, a cutting blade is capable of engaging materials that protrude above the surface from which roofing materials are removed and, more preferable, a cutting blade is capable of removing such materials from that surface. A cutting edge, in certain embodiments, has the shape of a leading edge that protrudes forward from the ramp.

In certain other embodiments, a cutting blade and ramp of a tool of the invention engage in reciprocating movements like the blades of the tool, and in certain preferred embodiments the blade, the ramp and the cutting blade of a tool are connected, or possibly made as a single piece, and thus engage in reciprocating movements in parallel. In certain other embodiments, a cutting blade and ramp of a tool are moved forward through the powered drive-wheel(s) of a tool.

A ramp and a cutting edge of a tool of the invention, in certain embodiments, are made of a material of sufficient strength to engage roofing materials that are to be removed from a roof or surface. In certain embodiments, a ramp or cutting edge is made of a metal or an alloy, or of the same material as the blades of the tool.

5.2.3 Drive-Wheel.

A tool of the current invention, in certain embodiments, comprises a drive-wheel. A drive-wheel of a tool of the invention, in certain embodiments, is located so that it reaches the surface on which the tool is used while the blades of the tool may pry loose roofing materials on the surface. In certain other embodiments, the drive-wheel is powered through the powering mechanism of the tool. A drive-wheel according to certain embodiments may be from 1 to 50 centimeters (cm) in diameter, or from 2 to 40 cm, or from 3 to 30 cm, or from 4 to 20 cm, or from 5 to 15 cm, or from 8 to 12 cm. A drive-wheel according to certain embodiments may be from 0.3 to 50 centimeters (cm) wide, or from 0.5 to 40 cm, or from 1 to 30 cm, or from 1.5 to 20 cm, or from 2 to 10 cm, or from 2.5 to 5 cm. A tool of the invention may have, in certain embodiments, varying numbers of drive-wheels, for example, 1, 2, 3, 4, 5, 6, 7, 8, or more drive-wheels. In certain other embodiments, all of the drive-wheels may be powered through a remote power source, or less than all drive-wheels may be powered through a remote power source, for example, only 1 wheel may be powered, or 2, 3, 4, 5, 6, 7, 8, or more. In certain other embodiments, the drive-wheels of a tool of the invention may be of the same or of different diameters and/or widths. One or more drive-wheels may be located on a tool of the invention in any pattern, for example, on the rear of the spade assembly (in other words, opposite the leading edge of the blades) either on the outside corner(s), more centered, fully centered, or in any other arrangement along the rear. One or more drive-wheels may also be located, in certain embodiments, on the sides or on the bottom of the spade assembly in any arrangement desirable that facilitates the operation of the tool.

A drive-wheel, in certain embodiments, may be made of one or more materials. For example, the wheel rim which contacts the roof or other surface may be made of one material and the center part of the wheel of a different material. Suitable materials include rubber, plastic, metal, an alloy, a light metal, a composite material, or any other material. The wheel rim, in certain embodiments, is made of a softer material than the wheel center. In certain other embodiments, the wheel rim and the wheel center are made of the same materials.

In certain other embodiments, a drive-wheel may have teeth on its rim that contacts the roof or other surface. Teeth on a drive-wheel, in certain embodiments, are extensions capable of increasing the friction or traction of the drive-wheel on the roof or other surface to improve the drive-wheel's ability to move the tool forward, for example, to push the blades of the tool underneath roofing materials. Teeth on a wheel may have any shape, for example, half-circles, triangles, diamonds, rectangles, ovals, squares, or any other shape. The teeth, in certain embodiments, may be of the same material as the rim and/or the center of the wheel the teeth are on, or of a different material. The maximum height of the teeth, when measured from the outside of the wheel rim to the tip of the teeth, in certain embodiments, is from 1 to 50 mm, or from 2 to 40 mm, or from 5 to 30 mm, or from 8 to 20 mm, or from 12 to 16 mm. The maximum width of the teeth, in certain embodiments, is from 1 to 100 mm, or from 2 to 80 mm, or from 5 to 60 mm, or from 10 to 40 mm, or from 15 to 25 mm. In certain other embodiments, the maximum width of the teeth is the width of the drive-wheel the teeth are on, or from 1 to 80 percent the width of the drive-wheel, or from 5 to 50 percent, or from 10 to 20 percent. The spacing of teeth, in certain embodiments, when measured in any direction on the surface of the wheel rim, is from 1 to 100 mm, or from 2 to 80 mm, or from 4 to 60 mm, or from 6 to 40 mm, or from 8 to 20 mm. The teeth on a wheel may be spaced differently in different dimensions (for example, along the direction in which the tool moves during operation and perpendicular thereto) on the wheel rim, or they may be spaced the same. The arrangement of teeth on a wheel, in certain embodiments, may be in rows, staggered rows, randomly, or any other arrangement. In certain other embodiments, the teeth on different drive-wheels of a tool may be of different, or the same, materials, shapes, sizes, spacing and/or arrangement. In certain other embodiments, the teeth on one drive-wheel of a tool of the invention may be of different, or the same, materials, shapes, sizes, spacing and/or arrangement.

5.2.4 Powering Mechanism.

A tool of the current invention, in certain embodiments, comprises a powering mechanism. A powering mechanism, in certain embodiments, is a mechanism that facilitates movement of blades and/or a drive-wheel of a tool of the invention. In certain preferred embodiments, power from a remote power source moves one or more components of the powering mechanism, which directly or indirectly drives movement of blades and/or a drive-wheel of a tool of the invention.

A powering mechanism of a tool of the invention, in certain embodiments, moves the blades of the tool, preferably in a reciprocating or intermittent manner, and preferably towards the roofing materials that are to be removed, and possibly back. In certain other embodiments, the powering mechanism rotates a drive-wheel of the tool of the invention. Moving the blades of a tool of the invention, in certain embodiments, is accomplished by moving the blades individually, in groups, and preferably all blades of a tool at the same time and most preferably in parallel so that all blades move forward and back at the same time. Moving the blades is accomplished, in certain embodiments, by attaching the blades to a rod and by moving the rod back and forth, for example, by pushing the rod in a backward position (in other words, counter the direction in which the tool is moved during operation) through one or more springs and by periodically pushing the rod to a forward position, for example, by engaging the rod through the cams of a camshaft. In certain embodiments, the camshaft may be rotated through the power delivered to the tool from the remote power source, for example, through air pressure. In certain other embodiments, the rod is moved back and forth by connecting it to the periphery of a rotating wheel or disk and by rotating the wheel or disk through the power delivered to the tool from the remote power source. In certain other embodiments, the rotational movement of a camshaft or rotating wheel or disk (for moving a rod that is attached to the blades) is used to rotate a drive-wheel of the tool of the invention.

In certain embodiments, the powering mechanism is reversible to facilitate changing the direction in which blades and/or drive-wheels are powered. The power delivered to the tool from a remote power source can be applied to moving the blades and a drive-wheel through any arrangement of one or more pistons, gears, cams, camshafts, chains, belts, rack and pinions, pulleys, levers, bell cranks, ratchets, wheels, carden gears, cranks, quick returns, geneva stops, worm gears, bevel gears, springs, hydraulics, or other mechanical linkages known in the art.

5.3 Power Source and Power Delivery.

In certain embodiments, power is delivered to a tool of the invention from a remote power source. In certain preferred embodiments, power is delivered from a remote power source to a powering mechanism of the tool of the invention. A remote power source, in certain embodiments, is preferably used to drive one or more components of a powering mechanism of a tool of the invention, preferably so that the powering mechanism can power all or a part of the movement of blades and/or a drive-wheel of a tool of the invention.

Any power that can be delivered to a tool of the invention for powering the powering mechanism for moving blades of the tool and/or for rotating a drive-wheel of the tool can be used. Power sources that can be used include air-pressure, hydraulic pressure, electric power, battery power, gasoline power, diesel power, propane power, natural gas power, fuel cells, hydrogen power, chemical power, or the power of other fuel sources. A preferred embodiment uses air-pressure to power a tool of the invention, for example, air-pressure generated by a remote compressor.

Power may be delivered from a remote power source to a tool of the invention through a cord, hose, or by any other means. In certain preferred embodiments, power is delivered by supplying the tool with compressed air through a hose. The means for delivering power from a remote power source to a tool of the invention can be connected to the tool at any one or more locations, for example, on the spade assembly, on a bar, or on a handle. A remote power source, in certain embodiments, is placed on the roof or next to the surface from which roofing materials are to be removed. In certain other embodiments, a remote power source may be carried, for example as a back pack, by a person, for example an operator of a tool of the invention.

5.4 Handle.

A tool of the current invention, in certain embodiments, comprises 1, 2, 3, 4, 5, or more handles for the operator to hold the tool during operation. A handle, in certain embodiments, may be horizontal, vertical, or slanted during operation of the tool. In certain other embodiments, the handle may be straight, it may have a two handed t-shape, it may comprise a round grip, or any shape. In certain other embodiments, a handle on a tool of the invention is from 5 to 50 cm in length, or from 10 to 40 cm, or from 15 to 30 cm, or from 20 to 25 cm. The diameter of the handle, in certain embodiments, is from 1 to 10 cm, or from 2 to 7 cm, or from 3 to 4 cm. In certain preferred embodiments, a tool of the invention comprises a handle at the end of a bar connecting the handle to the spade assembly of the tool. In certain other embodiments, a tool of the invention comprises one or more handles at any position along the bar, for example, in the middle of the bar, at any distance from either end of the bar (for example, by turning a section of the bar into a handle shape with enhanced grip for the operator). In certain other embodiments, a tool of the invention comprises one or more handles on the spade assembly.

5.5 Power Switch.

A tool of the invention, in certain embodiments, comprises a power switch to turn the delivery of power to the powering mechanism of the tool on or off. In certain embodiments, the power switch automatically turns power delivery off unless the operator holds the power switch in an on position (in other words, a safety switch). In certain other embodiments, a tool of the invention comprises a switch capable of maintaining an on and an off position and a safety switch requiring engagement by the operator for the on position. Either type of switch may be located at any position, for example on the spade assembly, on the bar, and/or on a handle or either end of a handle. A safety switch, in certain preferred embodiments, is located on a handle and most preferably a handle that is considered the primary handle for the operator to hold the tool during operation. A switch may be operated in any way known in the art, for example, through pressure, electrical contact, or any other means.

5.6 Bar.

A tool of the invention, in certain embodiments, comprises a bar, for example a bar connecting the spade assembly with a handle. A bar, in certain embodiments, has a length from 0 to 200 cm, or from 5 to 50 cm, or from 10 to 45 cm, or from 20 to 40 cm, or from 100 to 200 cm, or from 120 to 180 cm, or from 140 to 160 cm. In certain other embodiments, a bar may be telescopic allowing that the bar may be extended or reduced in length depending on the operator and/or the application, for example, a telescopic bar may allow varying the length of the bar from 10 to 30 cm, or from 20 to 60 cm, or from 30 to 90 cm, or from 40 to 120 cm, or from 50 to 150 cm, or any other combination. In certain embodiments, a bar of a tool of the invention has a diameter from 1 to 5 cm, or from 2 to 4 cm, or from 2.5 to 3.5 cm. A bar may be made of any material of sufficient stability and durability, for example, a metal, an alloy, a plastic, a composite material, or any other material. In certain other embodiments, more than one bar may be used with a tool of the invention and the bar may be removed and/or exchanged with another bar depending on the application and/or user of the tool. Where power is delivered through a bar, or through a portion of a bar, to a powering mechanism of a tool of the invention, the bar is preferably designed to facilitate such power delivery, for example, by making the bar hollow on the inside.

5.7 Using Tools of the Invention.

A tool of the invention, in certain embodiments, can be used for removing roofing materials from a roof or other surface, for example a shingled sidewall or a sidewall with siding. Shingles or siding which may be removed using a tool of the invention may be made of any kind of material, for example, wood, asphalt, stone, concrete, aluminum, or any other materials. In certain embodiments, the invention comprises methods for removing roofing materials from a roof or other surface using a tool of the invention.

5.8 Making Tools of the Invention.

A tool of the invention may be manufactured using any known method for tool construction known in the art.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited publications, patents, and patent applications are herein incorporated by reference in their entirety for any purpose.

What is claimed is:

1. A tool for removing shingles comprising:

a bar;

a handle;

a spade assembly, said spade assembly comprising from 2 to 2000 blades;

a drive-wheel;

a powering mechanism to facilitate a powered reciprocating motion of said blades and a powered rotation of said drive-wheel, said powering mechanism being operably coupled with the drive-wheel for said powered rotation of said drive-wheel moving the tool forward, said powering mechanism also being operably coupled with a drive shaft connected to said blades resulting in said reciprocating movement of said blades moving the blades forward and backward;

a guide including a guide shaft moveable therein said guide shaft connected to the blades, wherein said guide facilitates said blades engaging in said reciprocating movement without rotation around said drive shaft;

wherein power is delivered through said bar to said powering mechanism;

wherein said blades comprise a leading edge and a body, said leading edge engaging said shingled surface at a shallower angle than said body; and wherein said blades are capable of prying up shingles on a roof through forward motion.

2. The tool according to claim 1, said tool further comprising a power switch.

3. The tool according to claim 1, said tool further comprising a ramp between said blades.

4. The tool according to claim 3, said tool further comprising a cutting edge at the bottom of said ramp.

5. The tool according to claim 1, said tool further comprising power delivery means to facilitate supplying power to the tool.

6. The tool according to claim 5, said tool further comprising a remote power source.

7. The tool according to claim 1, wherein said powering mechanism comprises a pneumatic hose and a pneumatic cylinder.

8. The tool according to claim 1, wherein said drive-wheel has teeth.

9. A method for removing shingles comprising the steps of:

providing a tool having a bar, a handle, a spade assembly, said spade assembly comprising from 2 to 2000 blades, a drive-wheel, a powering mechanism to facilitate a powered reciprocating motion of said blades and a powered rotation of said drive-wheel, said powering mechanism being operably coupled with the drive-wheel for said powered rotation of said drive-wheel moving the tool forward, said powering mechanism also being operably coupled with a drive shaft connected to said blades resulting in said reciprocating movement of said blades moving the blades forward and backward, a guide including a guide shaft moveable therein said guide shaft connected to the blades, wherein said guide facilitates said blades engaging in said reciprocating movement without rotation around said drive shaft, wherein power is delivered through said bar to said powering mechanism, wherein said blades comprise a leading edge and a body, said leading edge engaging said shingled surface at a shallower angle than said body; and removing shingles by said blades capable of prying up shingles on a roof through forward motion.

* * * * *